US009822601B2

(12) United States Patent
Nguyen et al.

(10) Patent No.: US 9,822,601 B2
(45) Date of Patent: Nov. 21, 2017

(54) SYSTEM FOR SETTING AND RETRIEVING A SEAL ASSEMBLY

(71) Applicant: Cameron International Corporation, Houston, TX (US)

(72) Inventors: Dennis P. Nguyen, Pearland, TX (US); Kristin Vorderkunz, Houston, TX (US); Frank Z. Pei, Houston, TX (US)

(73) Assignee: Cameron International Corporation, Houston, TX (US)

( * ) Notice: Subject to any disclaimer, the term of this patent is extended or adjusted under 35 U.S.C. 154(b) by 407 days.

(21) Appl. No.: 14/449,830

(22) Filed: Aug. 1, 2014

(65) Prior Publication Data

US 2016/0032674 A1 Feb. 4, 2016

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/043; E21B 33/03; E21B 33/02; E21B 23/00; F16J 15/028
See application file for complete search history.

(56) References Cited

U.S. PATENT DOCUMENTS 3,543,847 A * 12/1970 Haeber ..... E21B 33/043 166/115
3,809,158 A * 5/1974 Bonds ..... E21B 33/043 166/285
3,897,823 A * 8/1975 Ahlstone ..... E21B 23/04 166/120
3,972,546 A * 8/1976 Putch ..... E21B 33/043 166/182
4,030,544 A * 6/1977 Ahlstone ..... E21B 33/043 166/182
4,757,860 A * 7/1988 Reimert ..... E21B 33/035 166/123

(Continued)

FOREIGN PATENT DOCUMENTS

WO 2009/014795 A2 1/2009
WO 2015/057456 A1 4/2015

OTHER PUBLICATIONS

PCT International Search Report and Written Opinion; Application No. PCT/US2015/040188; dated Apr. 18, 2016; 13 pages.

*Primary Examiner* — Kipp Wallace
(74) *Attorney, Agent, or Firm* — Fletcher Yoder, P.C.

(57) ABSTRACT

A system includes a setting tool configured to set a sealing assembly within an annular space between a hanger and a wellhead. The setting tool comprises an outer annular sleeve and an inner annular sleeve disposed radially inward of the outer annular sleeve. The inner annular sleeve includes a flexible finger configured to removably couple the setting tool to the sealing assembly. The setting tool includes a shear pin extending between the outer annular sleeve and the inner annular sleeve. The shear pin is configured to break in response to axial compression of the setting tool to enable the outer annular sleeve to move axially relative to the inner annular sleeve, and the outer annular sleeve is configured to interact with the sealing assembly to set the sealing assembly within the annular space via axial movement of the outer annular sleeve relative to the inner axial sleeve.

13 Claims, 14 Drawing Sheets

(56) References Cited

U.S. PATENT DOCUMENTS

| | | | | | |
|---|---|---|---|---|---|
| 5,069,288 | A * | 12/1991 | Singeetham | E21B 33/043 | 166/208 |
| 5,174,376 | A * | 12/1992 | Singeetham | E21B 33/043 | 166/182 |
| 5,775,422 | A * | 7/1998 | Wong | E21B 23/02 | 166/135 |
| 8,347,966 | B2 * | 1/2013 | Nguyen | E21B 33/04 | 166/338 |
| 2013/0213661 | A1 * | 8/2013 | Reimert | E21B 33/043 | 166/348 |

* cited by examiner

SYSTEM FOR SETTING AND RETRIEVING A SEAL ASSEMBLY

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead through which the resource is extracted. These wellheads may have wellhead assemblies that include a wide variety of components and/or conduits, such as various casings, hangers, valves, fluid conduits, and the like, that control drilling and/or extraction operations. For example, a long pipe, such as a casing, may be lowered into the earth to enable access to the natural resource. Additional pipes and/or tubes may then be run through the casing to facilitate extraction of the resource.

In some instances, a hanger may be supported within the wellhead. In some cases, a tool is utilized to facilitate running and lowering a sealing mechanism into the wellhead to form a seal between the hanger and the wellhead. Typical tools lock the sealing mechanism in place within the wellhead via rotational movement of the tool. However, rotating tools may increase wear on the wall of the wellhead and may increase the duration of the locking setting process.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
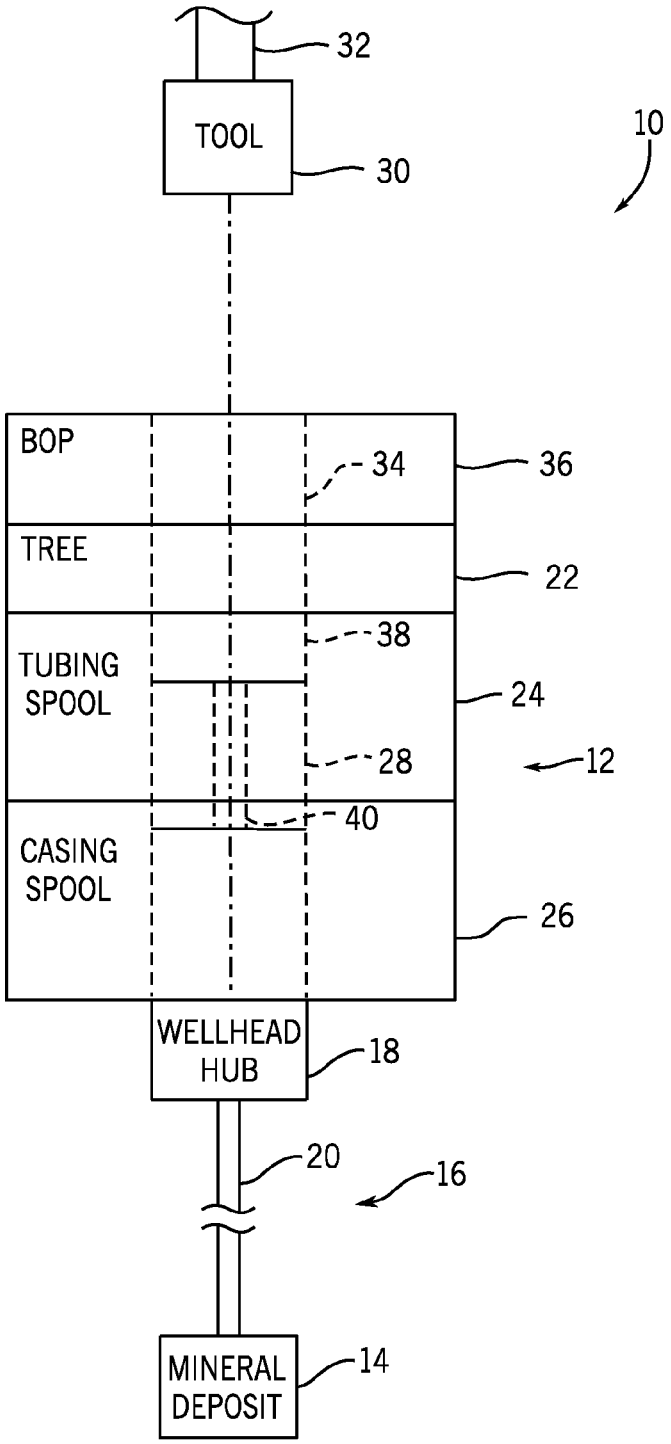
FIG. 1 is a block diagram of a mineral extraction system in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure include systems for setting and retrieving a sealing assembly within a wellhead of a mineral extraction system. In particular, the disclosed embodiments include a setting tool for lowering and setting the sealing assembly within the wellhead, and a retrieval tool for retrieving and lifting the sealing assembly from the wellhead. In certain embodiments, the setting tool lowers and sets the sealing assembly within the wellhead by moving (e.g., pushing) the setting tool axially downward into the wellhead until contacting a shoulder of a hanger or another structure of the wellhead. After contact with the shoulder, further axially downward movement of the setting tool induces a shear pin of the setting tool to break, thereby enabling the setting tool to drive a locking ring of the sealing assembly radially outward into a corresponding locking recess of the wellhead, which sets (e.g., locks) the sealing assembly in place within the wellhead. Additionally, in certain embodiments, the retrieval tool retrieves and lifts the sealing assembly from the wellhead by gripping the sealing assembly with an inner retrieval sleeve. After a flexible finger of the inner retrieval sleeve engages a corresponding retrieval recess of the sealing assembly, and further axially downward movement of the retrieval tool drives an outer support extension of an outer supporting sleeve into a position about the flexible finger. Once the inner retrieval sleeve is supported by the outer support extension, the sealing assembly may be removed by moving (e.g., pulling)

the retrieval tool axially upward from the wellhead. In certain embodiments, the setting tool and the retrieval tool set and retrieve the seal assembly, respectively, without rotational movement of any component of the setting tool or retrieval tool relative to the wellhead. As set forth above, typical setting tools rotate relative to the wellhead to set the sealing assembly in a desired position within the wellhead, and typical retrieval tools rotate relative to the wellhead to remove the sealing assembly from the wellhead. The presently disclosed embodiments enable efficient setting and retrieving of the sealing assembly via axial movement of the respective tools, as well as reduced wear on certain wellhead components (e.g., tubing spool, casing spool, or the like).

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and configured to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes a tree 22, a tubing spool 24, a casing spool 26, and a hanger 28 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 30 suspended from a drill string 32. As discussed in more detail below, in certain embodiments, the tool 30 may be a setting tool or a retrieval tool that is configured to be lowered (e.g., run) from an offshore vessel into the wellhead 12. In other embodiments, such as surface systems, the tool 30 may be a setting tool or a retrieval tool that is configured to be lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate device. The BOP 36 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead 12 and disposed in the tubing spool bore 38 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 is typically disposed within the wellhead 12 to secure tubing and casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20. As discussed in more detail below, one or more seal assemblies may be disposed between the hanger 28 and the tubing spool 24 and/or the casing spool 26 of the wellhead 12.

Figure 2:
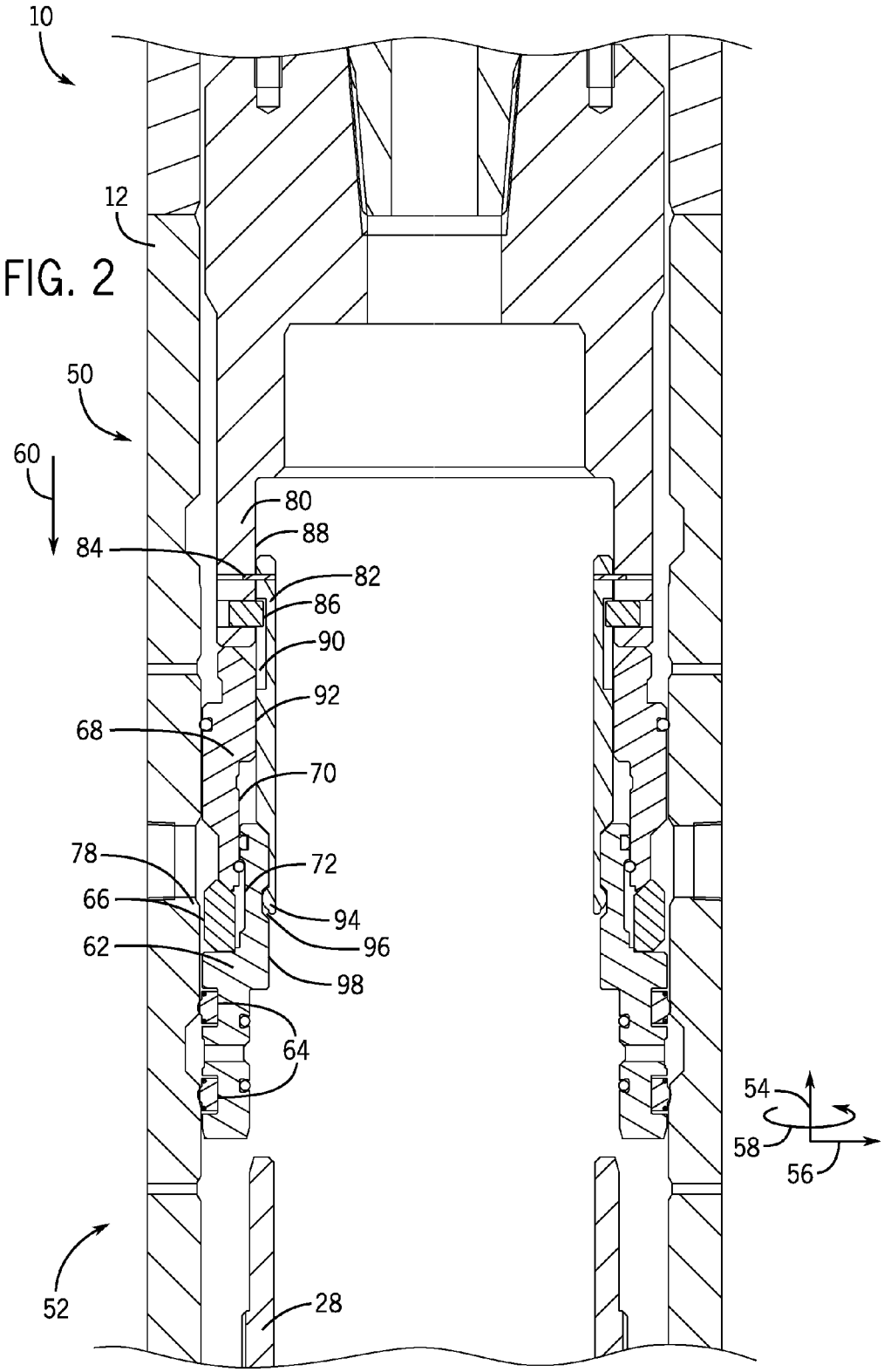
FIG. 2 is a partial cross-section of an embodiment of a setting tool and a sealing assembly disposed within a wellhead of the mineral extraction system of FIG. 1.

FIG. 2 is a partial cross-section of an embodiment of a setting tool 50 and a sealing assembly 52 disposed within the wellhead 12 of the mineral extraction system 10 of FIG. 1. The mineral extraction system 10, and the components therein, may be described with reference to an axial axis or direction 54, a radial axis or direction 56, and a circumferential axis or direction 58. In the illustrated embodiment, the setting tool 50 and the sealing assembly 52 are lowered together into the wellhead 12 toward the hanger 28, as shown by arrow 60, to facilitate installation of the sealing assembly 52 within the wellhead 12.

In the illustrated embodiment, the sealing assembly 52 includes a seal body 62 (e.g., an annular seal body or a lower ring) that supports lower annular seals 64 and a locking ring 66. The sealing assembly 52 also includes a push ring 68 (e.g., an annular push ring or an upper ring) disposed axially above the seal body 62 and having a radially inner surface 70 that is slidingly coupled to a radially outer surface 72 of the seal body 62. The sealing assembly 52 is shown in an extended configuration in which a portion of the radially inner surface 70 contacts the radially outer surface 72. As discussed in more detail below, the push ring 68 is configured to move along the axial axis 54 relative to the seal body 62 to facilitate transition of the sealing assembly 52 into a compressed configuration in which all or a substantial portion of the radially inner surface 70 contacts the radially outer surface 72. As discussed in more detail below, such movement of the push ring 68 also drives the locking ring 66 radially outward. Driving the locking ring 66 radially outward into a corresponding locking recess 78 formed in the wellhead 12 sets (e.g., locks) the sealing assembly 52 within the wellhead 12.

The locking ring 66 may have any suitable configuration for radially expanding to set the sealing assembly 52 within the wellhead 12. For example, in some embodiments, the locking ring 66 is a C-ring having a first end and a second end that define a space (e.g., a gap) at a circumferential location about the ring. Such a configuration enables radial expansion of the locking ring 66 into the corresponding locking recess 78, as a distance between the first end and the second end across the space increases in response to the axially downward movement of the push ring 68.

As shown, the setting tool 50 is positioned axially above the sealing assembly 52. The setting tool 50 includes an outer sleeve 80 (e.g., an outer annular sleeve) and an inner sleeve 82 (e.g., an inner annular sleeve). A shear pin 84 extends between and initially couples the outer sleeve 80 and the inner sleeve 82, thereby blocking axial movement of the outer sleeve 80 relative to the inner sleeve 82. In some embodiments, multiple discrete shear pins 84 may be spaced axially and/or circumferentially about the setting tool 50. In other embodiments, a single shear pin 84 may be provided. As discussed in more detail below, as the setting tool 50 is pushed downwardly (e.g., via a weight set) after the sealing assembly 52 is in a landing position on a shoulder of the hanger 28 or the wellhead 12, the shear pin 84 may shear (e.g., break), thereby enabling the outer sleeve 80 to move along the axial axis 54 relative to the inner sleeve 82.

The relative movement between the outer sleeve 80 and the inner sleeve 82 along the axial axis 54 is limited and/or guided by a slot guide 86 that protrudes radially inwardly from a radially inner surface 88 of the outer sleeve 80 and by a corresponding guiding slot 90 (e.g., recess) formed in an outer circumferential surface 92 of the inner sleeve 82. The slot guide 86 and the corresponding guiding slot 90 may extend circumferentially about all or a portion of the setting tool 50, or multiple discrete slot guides 86 and corresponding slots 90 may be spaced apart circumferentially about the setting tool 50.

As shown, the inner sleeve 82 includes a flexible finger 94 (e.g., protrusion) configured to engage a corresponding setting recess 96 disposed along a radially inner surface 98 of the seal body 62 and to couple the inner sleeve 82 to the seal body 62 (and thus, the setting tool 50 to the sealing assembly 52) as the sealing assembly 52 is lowered into the wellhead 12. The flexible finger 94 and the corresponding setting recess 96 may extend circumferentially about all or a portion of the setting tool 50/sealing assembly 52 or multiple discrete flexible fingers 94 and corresponding setting recesses 96 may be spaced apart circumferentially about the setting tool 50/sealing assembly 52.

Figure 3:
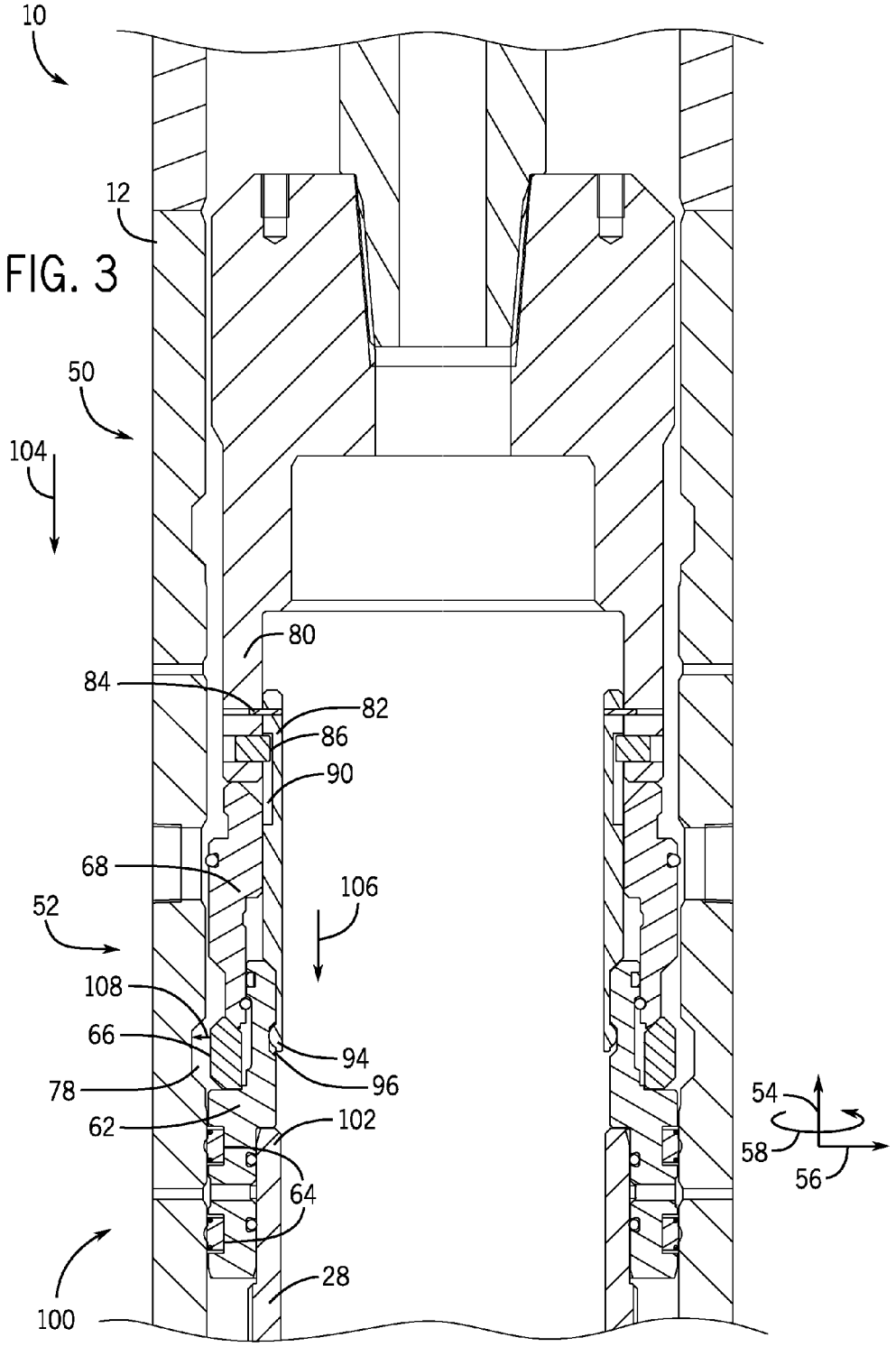
FIG. 3 is a partial cross-section of the setting tool coupled to the sealing assembly of FIG. 2, which is in a landing position between a hanger and the wellhead.

FIG. 3 is a partial cross-section of the setting tool 50 coupled to the sealing assembly 52, which is in a landing position 100 between the hanger 28 and the wellhead 12. In the landing position 100, the sealing assembly 52 contacts and/or is supported by a feature within the wellhead 12, such as a shoulder 102 of the hanger 28, but the sealing assembly 52 is not set (e.g., locked or secured) within the wellhead 12. While the sealing assembly 52 rests on the shoulder 102 of the hanger 28, further downward movement of the seal body 62 of the sealing assembly 52 is blocked. Additionally, further downward movement of the inner sleeve 82 is blocked by the seal body 62. However, once the sealing assembly 52 is in the landing position 100, further downward movement of the outer sleeve 80 of the setting tool 50 induces the shear pin 84 to shear, thereby enabling the outer sleeve 80 to move along the axial axis 54 relative to the inner sleeve 82 as shown by arrow 104. As discussed in more detail below, as the outer sleeve 80 moves axially downward relative to the inner sleeve 82, the outer sleeve 80 pushes the push ring 68 axially downward relative to the seal body 62 as shown by arrow 106, thereby driving the locking ring 66 radially outward, as shown by arrow 108, into the aligned corresponding locking recess 78 of the wellhead 12.

Figure 4:
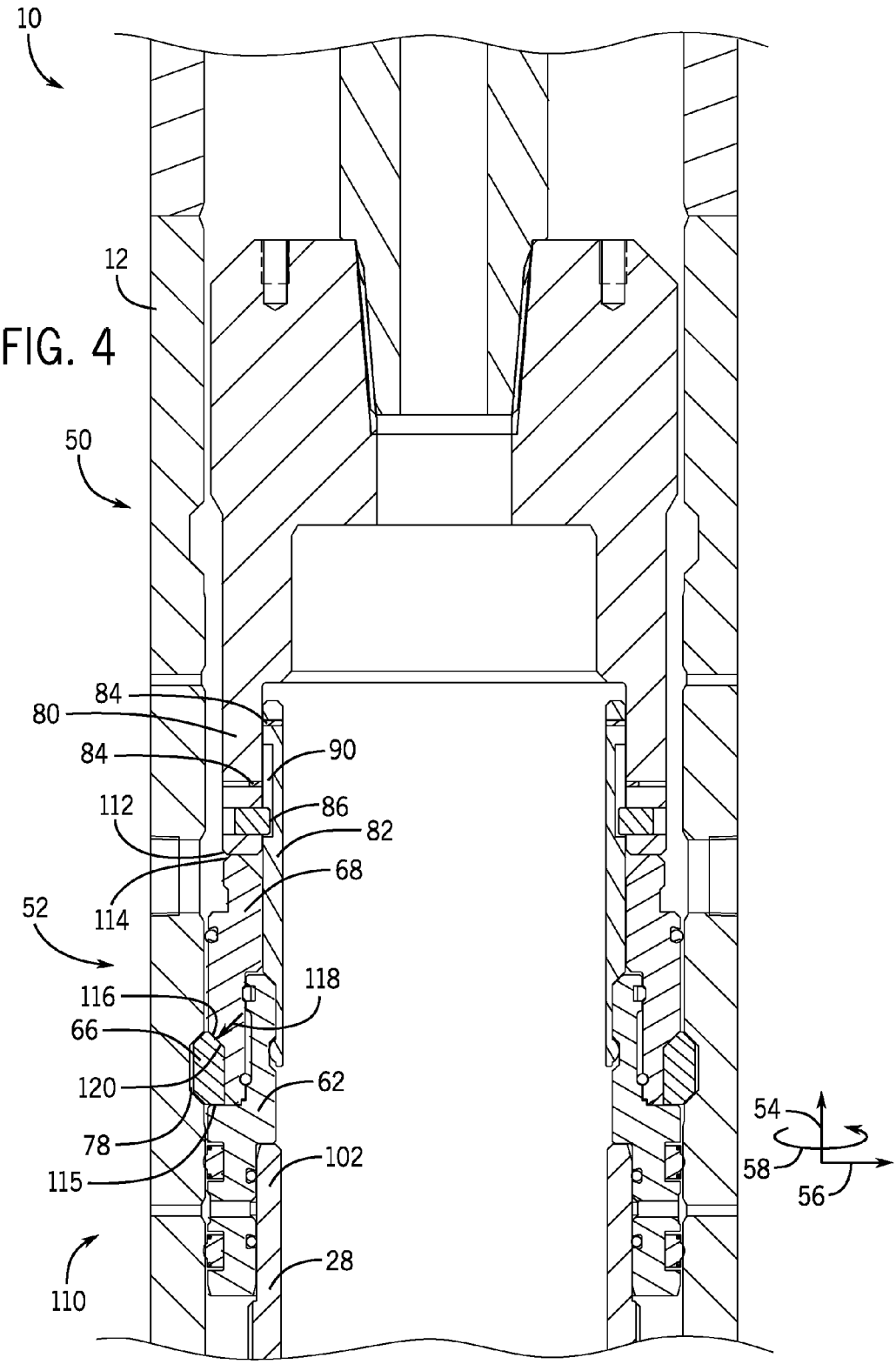
FIG. 4 is a partial cross-section of the setting tool and the sealing assembly of FIG. 2 in a set position between the hanger and the wellhead.

FIG. 4 is a partial cross-section of the sealing assembly 52 disposed in a set position (e.g., locked position) 110 between the hanger 28 and the wellhead 12 of the mineral extraction system 10. In the set position, the sealing assembly 52 is secured to the wellhead 12 via the locking ring 66 positioned within the corresponding locking recess 78. In the illustrated position, the locking ring 66 blocks movement of the sealing assembly 52 upwardly and downwardly along the axial axis 54 relative to the wellhead 12.

As mentioned above, the sealing assembly 52 moves from the landing position 100 of FIG. 3 to the set position 110 of FIG. 4 as the outer sleeve 80 of the setting tool 50 moves axially downward along the axial axis 54. Such movement shears the shear pin 84, thereby enabling the outer sleeve 80 to move axially downward relative to the inner sleeve 82. As shown, a lower axial surface 112 of the outer sleeve 80 is configured to contact an upper axial surface 114 of the push ring 68 of the sealing assembly 52. Thus, as the outer sleeve 80 moves axially downward, the outer sleeve 80 pushes the push ring 68 axially downward, thereby driving the locking ring 66 to move radially outward into the corresponding locking recess 78 to lock the sealing assembly 52 in place within the wellhead 12. In particular, as shown, the seal body 62 supports a lower surface 115 of the locking ring 66 and blocks axially downward movement of the locking ring 66. A lower radially outwardly facing angled surface 116 of the push ring 68 applies a force 118 to an upper radially inwardly facing angled surface 120 of the locking ring 66, thereby urging the locking ring 66 to move radially outward into the corresponding locking recess 78 to lock the sealing assembly 52 in place within the wellhead 12. When the locking rink 66 is disposed within the corresponding locking recess 78, the locking ring 66 is configured to support loads applied to the top and the bottom of the sealing assembly 52. As noted above, the slot guide 86 that protrudes from the outer sleeve 80 moves axially within the corresponding guiding slot 90 of the inner sleeve 82. The slot guide 86 and the corresponding guiding slot 90 may be configured to limit and/or guide the relative axial movement of the outer sleeve 80 relative to the inner sleeve 82 and/or block rotational movement of the outer sleeve 80 relative to the inner sleeve 82. In this manner, the setting tool 50 is configured to lower and set the sealing assembly 52 within the wellhead 12 via axial movement of the setting tool 50 and without rotation of any component of the setting tool 50 relative to the wellhead 12.

Figure 5:
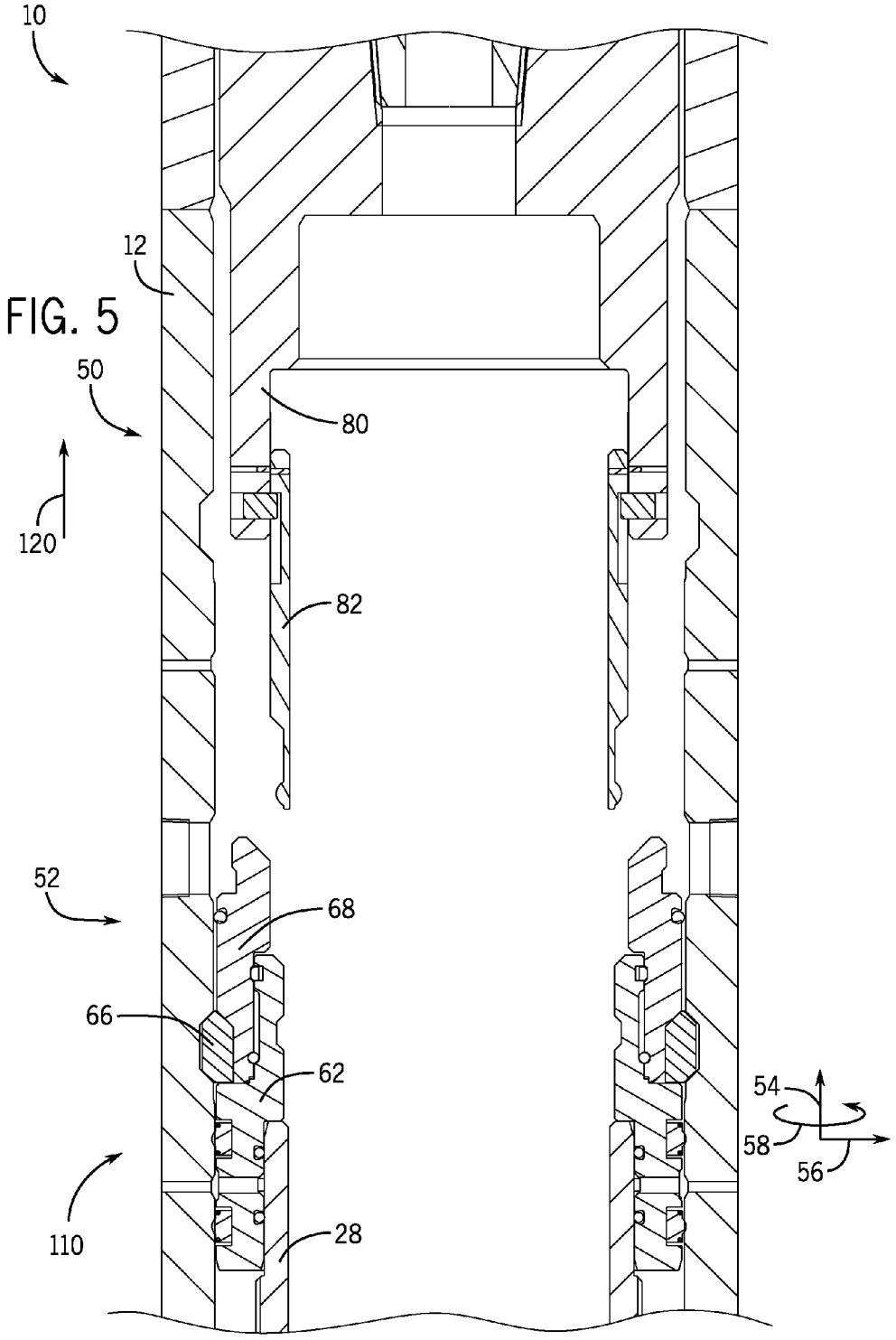
FIG. 5 is a partial cross-section of the setting tool of FIG. 2 separated from the sealing assembly.

FIG. 5 is a partial cross-section of the setting tool 50 separated from the sealing assembly 52. As noted above, the finger 94 of the inner sleeve 82 is flexible, and the locking ring 66 blocks axial movement of the sealing assembly 52 while the sealing assembly 52 is in the set position 110. Therefore, while the sealing assembly is in the set position 110, moving the setting tool 50 axially upward as shown by arrow 120 induces the flexible finger 94 to flex radially inwardly out of the corresponding setting recess 96, thereby enabling the setting tool 50 to separate from the sealing assembly 52. Through such a technique, the setting tool 50 is separated from the sealing assembly 52 and removed from the wellhead 12 without rotation of any component of the setting tool 50 relative to the wellhead 12. Furthermore, the setting tool 50 may not separate from the sealing assembly 52 unless the locking ring 66 is properly engaged with the corresponding locking recess 78. Thus, separation of the setting tool 50 from the sealing assembly 52 verifies that the locking ring 66 is engaged with the corresponding locking recess 78 and that the sealing assembly 52 is secured within the wellhead 12.

Figure 6:
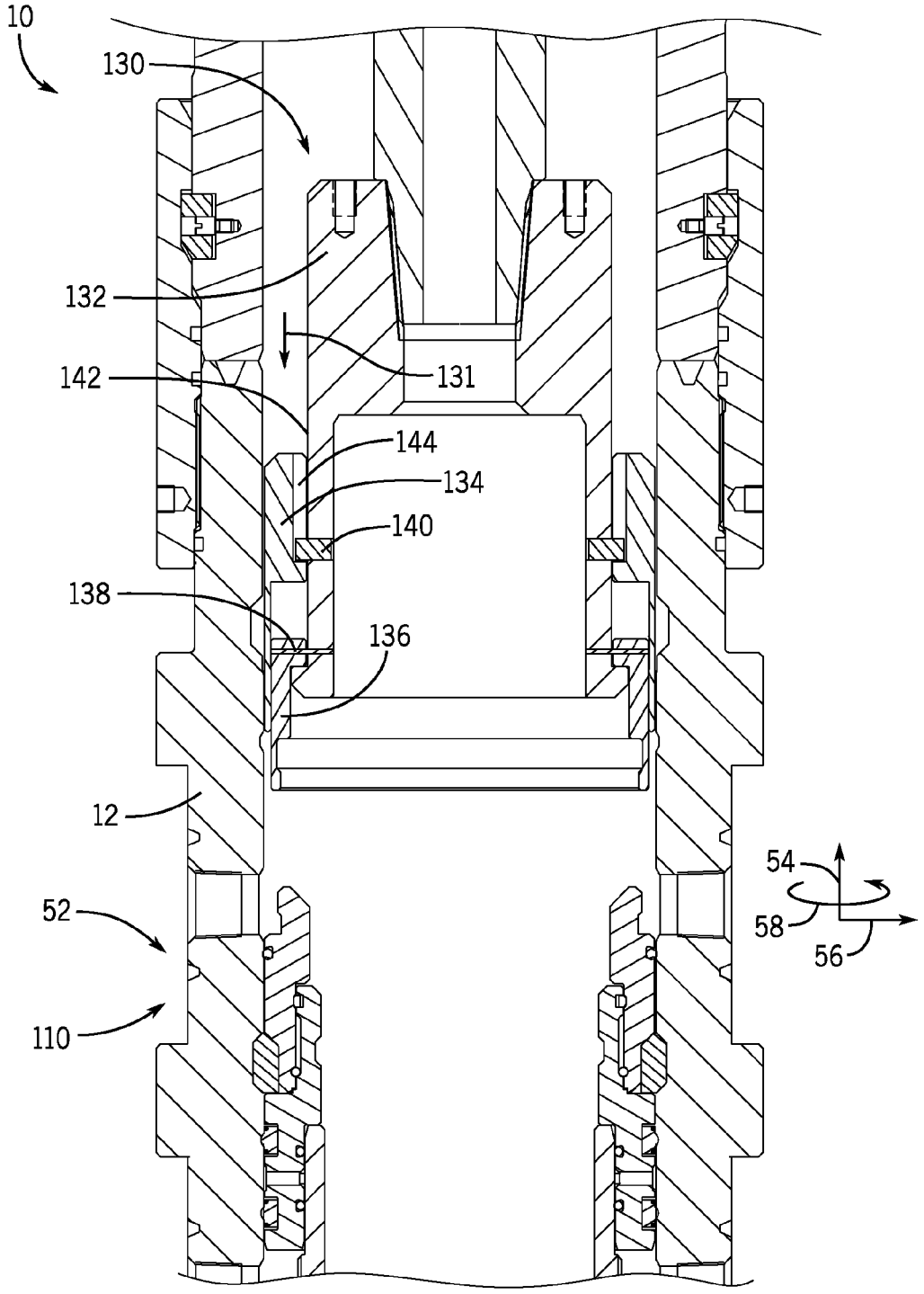
FIG. 6 is a partial cross-section of an embodiment of a retrieval tool disposed within a wellhead of the mineral extraction system of FIG. 1.

FIG. 6 is a partial cross-section of a retrieval tool 130 that is configured to retrieve the sealing assembly 52 from the wellhead 12. The retrieval tool 130 is configured to retrieve and lift the sealing assembly 52 from the wellhead 12 via axial movement of the retrieval tool 130 and without rotation of any component of the retrieval tool 130 relative to the wellhead 12. As shown, the retrieval tool 130 is positioned within the wellhead 12 and lowered axially in the direction 131 toward the sealing assembly 52, which is in the set position 110. The retrieval tool 130 includes a retrieval tool body 132 (e.g., an annular retrieval tool body), an outer supporting sleeve 134 (e.g., an annular outer supporting sleeve), and an inner retrieval sleeve 136 (e.g., an annular inner retrieval sleeve). A retrieval shear pin 138 extends between and is coupled to the retrieval tool body 132 and the inner retrieval sleeve 136. In some embodiments, multiple discrete retrieval shear pins 138 may be spaced circumferentially about the retrieval tool 130. In other embodiments, a single shear retrieval pin 138 may be provided. A positional lug 140 protrudes from a radially outer surface 142 of the retrieval tool body 132 and into an angled slot 144 (e.g., an L-shaped slot) of the outer supporting sleeve 134. Any suitable number of positional lugs 140 and angled slots 144 may be provided, such as 1, 2, 3, 4, 5, or more circumferentially distributed about the outer supporting sleeve 134, for example.

Figure 7:
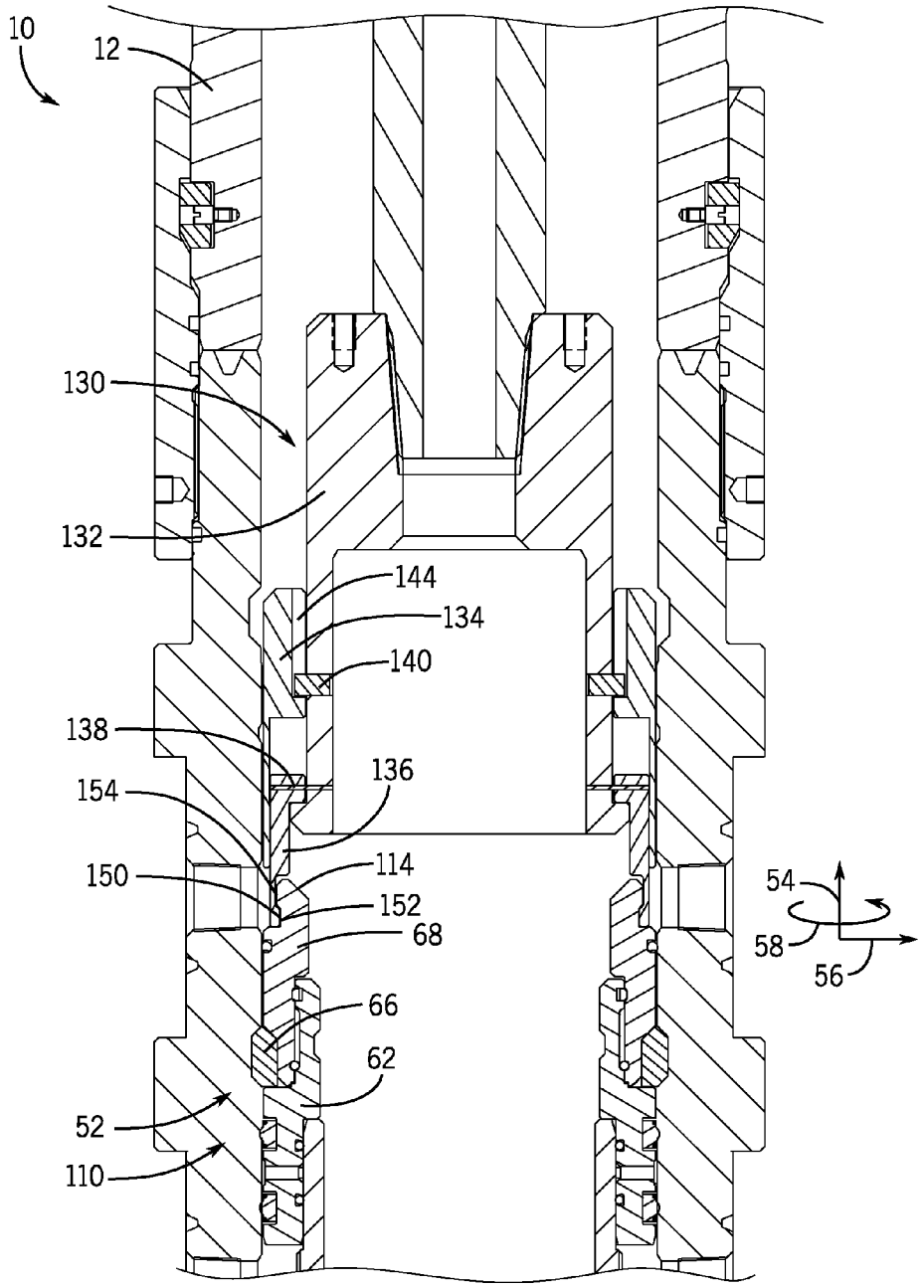
FIG. 7 is a partial cross-section of the retrieval tool of FIG. 6, in which an inner retrieval sleeve of the retrieval tool is coupled to a sealing assembly.

FIG. 7 is a partial cross-section of the retrieval tool 130 coupled to the sealing assembly 52. In particular, as the retrieval tool 130 is lowered axially toward the sealing assembly 52, a flexible finger 150 of the inner retrieval sleeve 136 flexes radially outward, in response to contact with the push ring 68. The flexible finger 150 then engages a corresponding retrieval recess 152 formed in a radially outward surface 154 of the push ring 68. The flexible finger 150 and the corresponding retrieval recess 152 may extend circumferentially about all or a portion of the retrieval tool 130, or multiple discrete flexible fingers 150 and corresponding retrieval recesses 152 may be spaced apart circumferentially about the retrieval tool 130.

Figure 8:
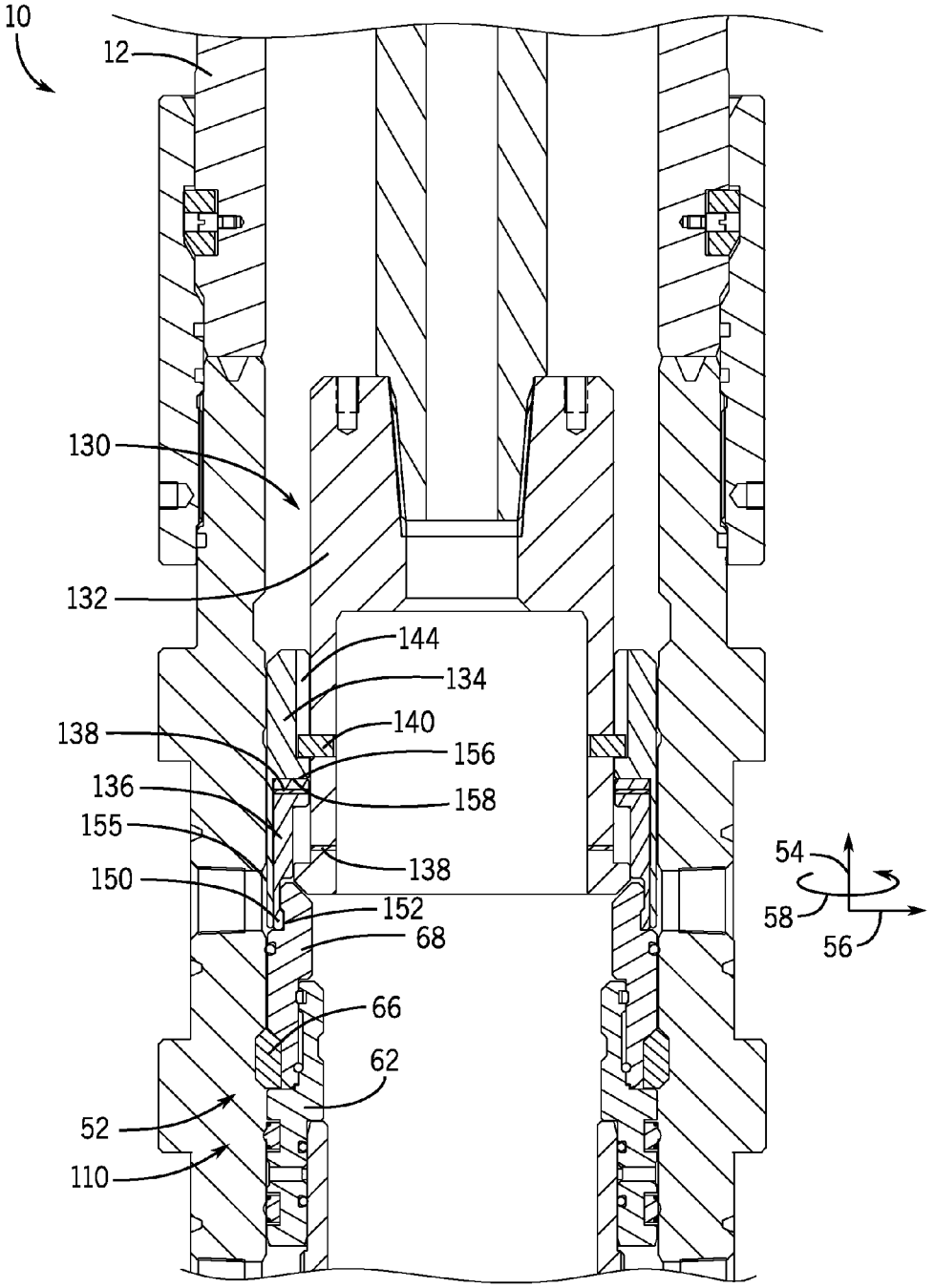
FIG. 8 is a partial cross-section of the retrieval tool of FIG. 6, in which an outer locking sleeve of the retrieval tool is disposed about the inner retrieval sleeve of the retrieval tool to secure the retrieval tool to the sealing assembly.

FIG. 8 is a partial cross-section of the retrieval tool 130, in which the outer supporting sleeve 134 of the retrieval tool 130 is disposed about the inner retrieval sleeve 136 of the retrieval tool 130, thereby securing the retrieval tool 130 to the sealing assembly 52. Once the flexible finger 150 of the inner retrieval sleeve 136 engages the corresponding retrieval recess 152 of the push ring 68, the inner retrieval sleeve 136 is blocked from further downward axial movement via contact between the flexible finger 150 and the corresponding retrieval recess 152 of the push ring 68. Thus, further movement of the retrieval tool body 132 axially downward shears the shear pin 138 and enables the retrieval tool body 132 to move axially downward relative to the inner retrieval sleeve 136.

As shown, the positional lug 140 extends into the angled slot 144 of the outer supporting sleeve 134. Thus, movement of the retrieval tool body 132 axially downward induces the outer supporting sleeve 134 to move axially downward via contact between the positional lug 140 and a bottom axial surface of the angled slot 144. Such movement drives an outer support extension 155 of the outer supporting sleeve 134 into a position radially outward of the flexible finger 150 of the inner retrieval sleeve 136. The outer support extension 155 rigidly supports the flexible finger 150 and blocks the flexible finger 150 from flexing radially outward, or otherwise moving, out of the corresponding retrieval recess 152 of the push ring 68. In the illustrated embodiment, the outer supporting sleeve 134 moves axially downward until a lower axial surface 156 of the outer supporting sleeve 134 contacts an upper axial surface 158 of the lower retrieval sleeve 136.

Figure 9:
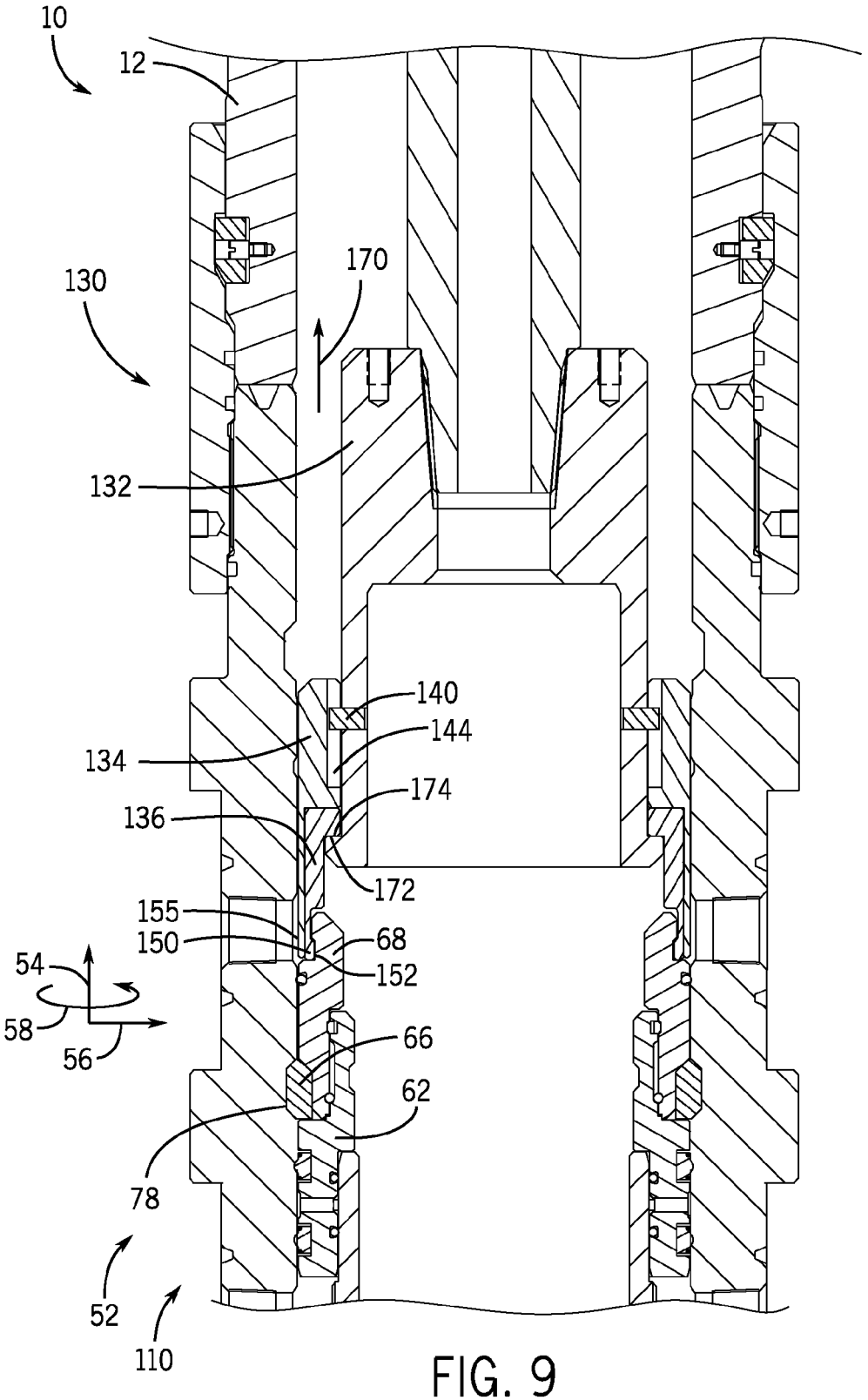
FIG. 9 is a partial cross-section of the retrieval tool of FIG. 6 removing the sealing assembly from the wellhead.

FIG. 9 is a partial cross-section of the retrieval tool 130 removing the sealing assembly 52 from the wellhead 12. To remove the sealing assembly 52, the retrieval tool body 132 is pulled axially upward, as shown by arrow 170. The positional lug 140 is disposed within the angled slot 144 of the outer supporting sleeve 134 in an orientation (e.g., a position along the circumferential axis 58) that enables the positional lug 140 to move axially upward within the angled slot 144 and relative to the outer supporting sleeve 134. The retrieval tool body 132 is pulled axially upward until a lower axial surface 172 of the retrieval tool body 132 engages an upper lip 174 of the inner retrieval sleeve 136. As shown, the outer support extension 155 remains disposed radially outward of the flexible finger 150, thus enabling the outer support extension 155 to support the flexible finger 150 and to block the flexible finger 150 from flexing radially outward and disengaging the corresponding retrieval recess 152 of the push ring 68. With the flexible finger 150 within the corresponding retrieval recess 152, movement of the retrieval tool 130 axially upward draws the push ring 68 axially upward and transitions the sealing assembly 52 from the compressed configuration to the expanded configuration. In particular, as the push ring 68 moves axially upward, the locking ring 66 moves radially inwardly out of the corresponding recess 78, thereby unlocking the sealing assembly 52 from the wellhead 12 and enabling the sealing assembly 52 to move axially relative to the wellhead 12. With the sealing assembly 52 unlocked from the wellhead 12 and the flexible finger 150 within the corresponding retrieval recess 152, further axially upward movement of the retrieval tool 130 pulls the sealing assembly 52 axially upward. Thus, the retrieval tool 130 and the sealing assembly 52 may move together axially upward relative to the wellhead 12, thereby facilitating removal of the sealing assembly 52 from the wellhead 12.

Figure 10:
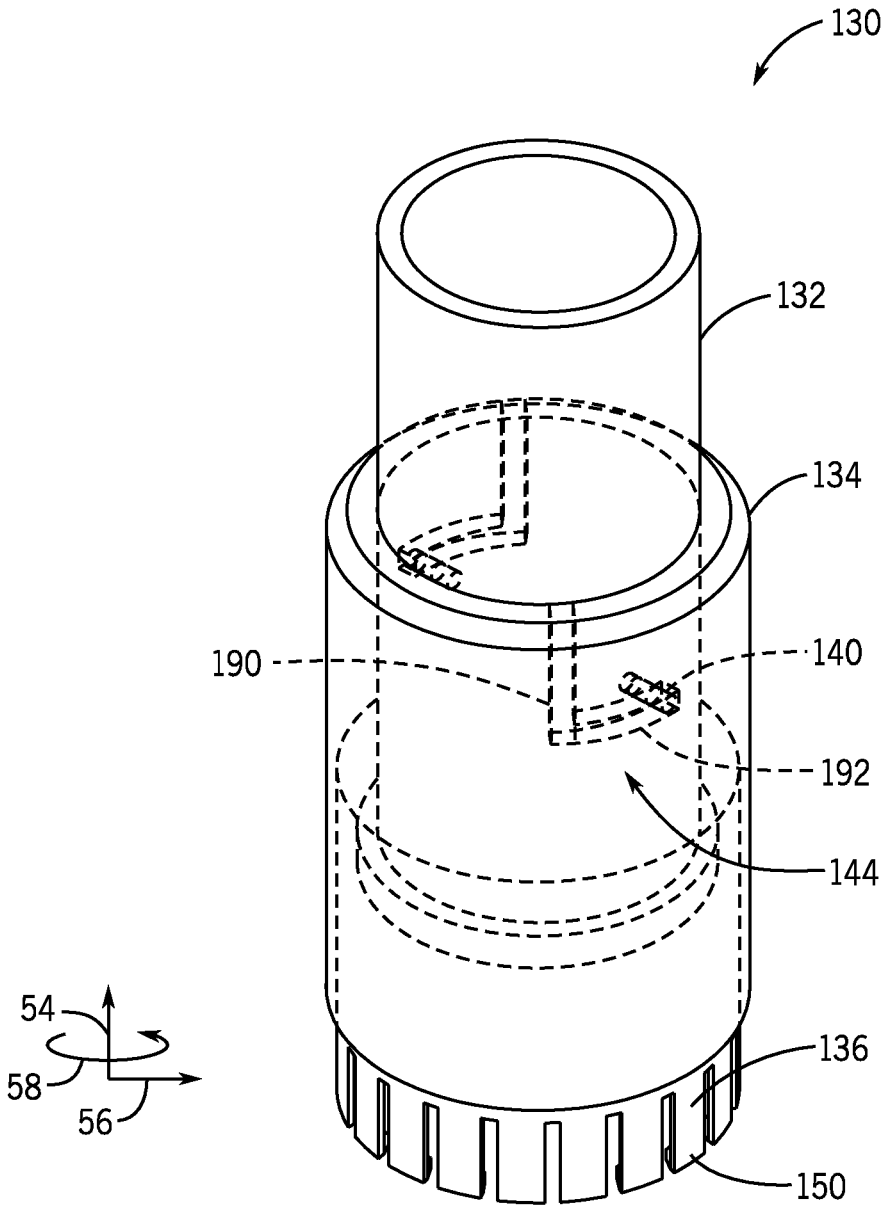
FIG. 10 is a perspective view of an embodiment of an outer locking sleeve of the retrieval tool of FIG. 6 including an annular slot that enables the retrieval tool to disengage from the sealing assembly.

FIG. 10 is a perspective view of a portion of the retrieval tool 130 with the angled slot 144 formed in the outer supporting sleeve 134. As shown, the angled slot 144 has a generally axial portion 190 and a generally circumferential portion 192. During a typical sealing assembly retrieval operation in accordance with the present embodiments, the positional lug 140 is circumferentially aligned with the axial portion 190 of the slot 144, thereby enabling the lug 140 to move axially within the axial portion 190 as set forth above. For example, circumferential alignment of the positional lug 140 with the axial portion 190 enables the retrieval tool body 132 to move axially upward relative to the outer supporting sleeve 134, thus facilitating retrieval of the sealing assembly 52 (e.g., by enabling the outer support extension 155 to remain in a position that blocks flexing of the finger 150). However, in certain circumstances, after the shear pin 138 shears and the outer support extension 155 moves to support the flexible finger 150, it may be desirable to separate the retrieval tool 130 from the sealing assembly 52 and to remove the retrieval tool 130 from the wellhead 12 while leaving the sealing assembly 52 in the set position 110. The angled slot 144 and the positional lug 140 facilitate such separation of the retrieval tool 130 from the sealing assembly 52.

In particular, to separate the retrieval tool 130 from the sealing assembly 52 while the retrieval tool 130 is in the lowered position as shown in FIG. 8, the retrieval tool body 132 may be rotated in the circumferential direction 58, thereby moving the positional lug 140 into the circumferential portion 192 of the angled slot 144. When the positional lug 140 is disposed within the circumferential portion 192 of the angled slot 144, the retrieval tool body 132 is blocked from moving axially relative to the outer supporting sleeve 134. Thus, movement of the retrieval tool body 132 axially upward drives the outer supporting sleeve 134 to move axially upward such that the outer support extension 155 is positioned axially above the flexible finger 150. Because the flexible finger 150 is not supported by the outer support extension 155, the flexible finger 150 flexes radially outward upon further axially upward movement of the retrieval tool body 132, thereby extracting the flexible finger 150 from the corresponding retrieval recess 152. Thus, the retrieval tool 130 separates from the sealing assembly 52, which remains in the set position 110.

Figure 11:
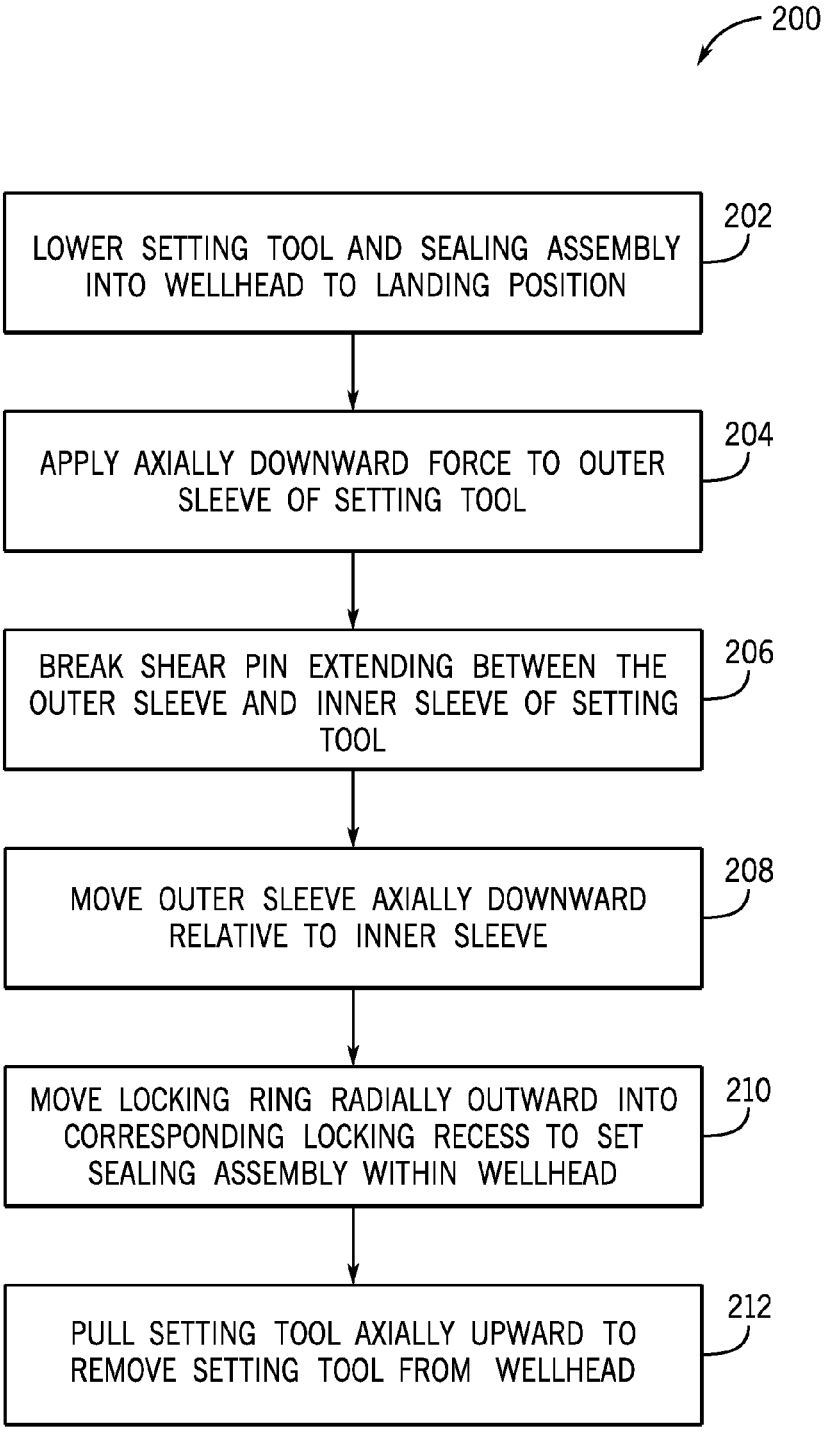
FIG. 11 is a flow diagram of an embodiment of a method for setting a sealing assembly within a wellhead.

FIG. 11 is a flow diagram of a method 200 for setting the sealing assembly 52 in place within the wellhead 12. The setting tool 50 and the sealing assembly 52 are lowered into the wellhead 12 until the sealing assembly 52 reaches the landing position 100, in step 202. As discussed above, a feature within the wellhead 12, such as the shoulder 102 of the hanger 28, may block further axially downward movement of the sealing assembly 52.

After the sealing assembly 52 reaches the landing position 100, an axially downward force is applied to the outer sleeve 80 of the setting tool 50, in step 204. Such axially downward force on the outer sleeve 80 shears the shear pin 84 extending between the outer sleeve 80 and the inner sleeve 82 of the setting tool 50, in step 206. Once the shear pin 84 shears, the outer sleeve 80 may move axially downward relative to the inner sleeve 82, in step 208.

The lower axial surface 112 of the outer sleeve 80 contacts the upper axial surface 114 of the push ring 68 of the sealing assembly 52. Thus, as the outer sleeve 80 moves axially downward, the outer sleeve 80 drives the push ring 68 axially downward, thereby driving the locking ring 66 radially outward into the corresponding locking recess 78, which locks the sealing assembly 52 in place within the wellhead 12, in step 210. In particular, as discussed above, the seal body 62 supports the lower axial surface 115 of the locking ring 66 and blocks axially downward movement of the locking ring 66. Upon axially downward movement of the push ring 68, the lower radially outwardly facing angled surface 116 of the push ring 68 applies the force 118 to the upper, radially inwardly facing angled surface 120 of the locking ring 66, thereby driving the locking ring 66 to move radially outward into the corresponding locking recess 78 to lock the sealing assembly 52 in place within the wellhead 12.

After the sealing assembly 52 is set in the set position 110 within the wellhead 12, the setting tool 50 may be removed from the wellhead 12 by pulling the setting tool 50 axially upward, in step 212. The locking ring 66 secures the sealing assembly 52 within the wellhead 12, and the flexible finger 94 flexes radially inward out of the corresponding setting recess 96 to enable separation of the setting tool 50 from the sealing assembly 52 as the setting tool 50 is pulled axially upward. The above disclosed method enables setting of the sealing assembly 52 within the wellhead via axial movement of the setting tool 50 and the sealing assembly 52, and without rotational movement of any component of the setting tool 50 or the sealing assembly 52 relative to the wellhead 12.

Figure 12:
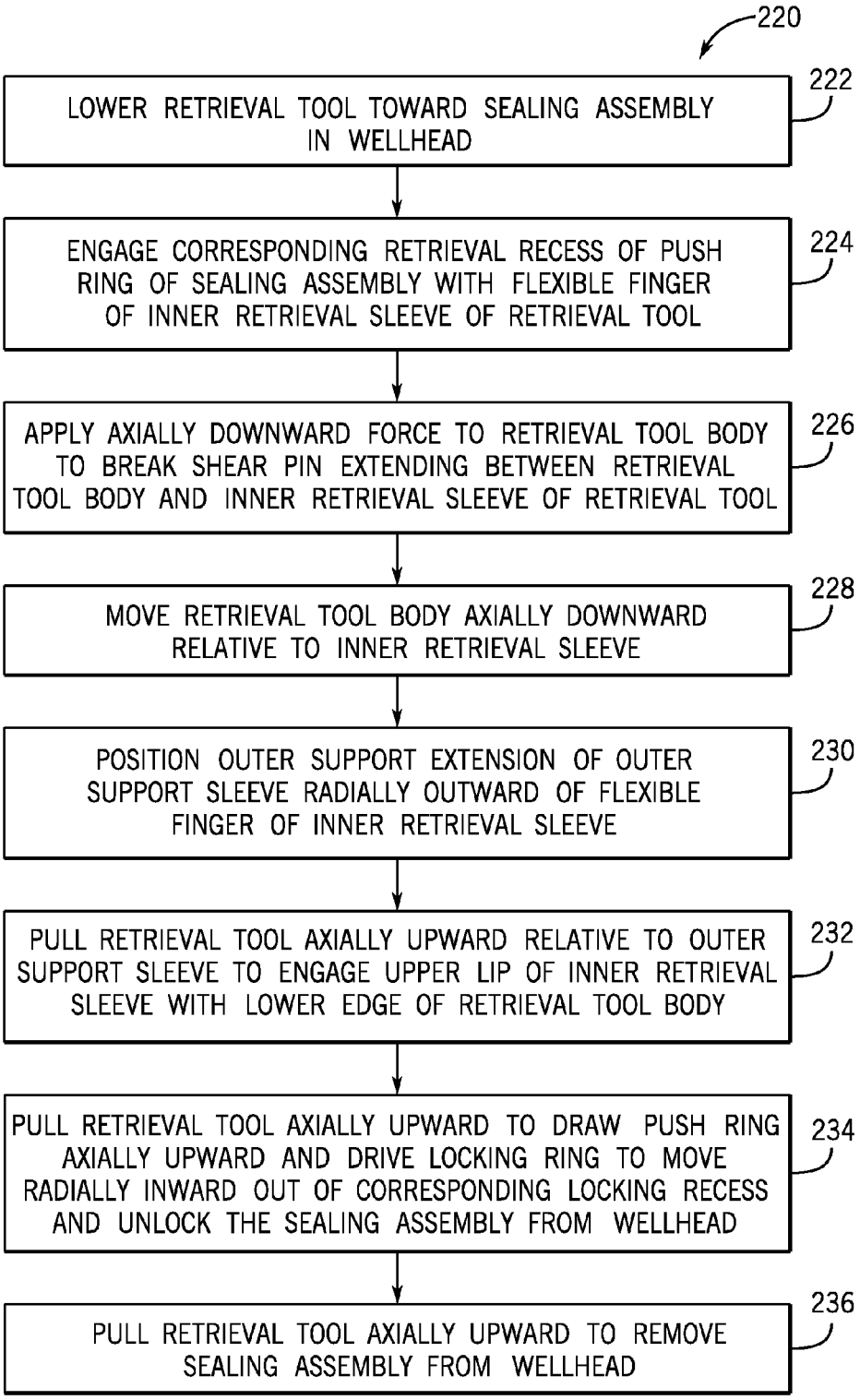
FIG. 12 is a flow diagram of an embodiment of a method for retrieving a sealing assembly from a wellhead.

FIG. 12 is a flow diagram of a method 220 for retrieving the sealing assembly 52 from the wellhead 12. The retrieval tool 130 is lowered into the wellhead 12 toward the sealing assembly 52, which may be in the set position 110, in step 222. As discussed above, the flexible finger 150 of the inner retrieval sleeve 136 flexes radially outward upon contact with the push ring 68, and then engages the corresponding retrieval recess 152 of the push ring 68, in step 224. Once the flexible finger 150 is positioned within the corresponding retrieval recess 152 of the push ring 68, further axially downward force applied to the retrieval tool body 132 shears the shear pin 138 extending between the retrieval tool body 132 and the inner retrieval sleeve 136, in step 226. Once the shear pin 138 shears, the retrieval tool body 132 may move axially downward relative to the inner retrieval sleeve 136, in step 228.

Such axially downward movement of the retrieval tool body 132 drives the outer supporting sleeve 134 to move axially downward, thereby positioning the outer support extension 155 of the outer supporting sleeve 134 radially outward of the flexible finger 150 of the inner retrieval sleeve 136, in step 230. The outer support extension 155 rigidly supports the flexible finger 150 and blocks the flexible finger 150 from flexing radially outward, or otherwise moving, out of the corresponding retrieval recess 152 of the push ring 68. Once the outer support extension 155 is in place to support the flexible finger 150, the retrieval tool body 132 is pulled axially upward relative to the outer supporting sleeve 134 until the lower axial surface 172 of the retrieval tool body 132 engages the upper lip 174 of the inner retrieval sleeve 136, in step 232. Further axially upward movement of the retrieval tool 130 draws the push ring 68 axially upward via contact between the flexible finger 150 and the corresponding retrieval recess 152, thereby driving the locking ring 66 to move radially inwardly out of the corresponding recess 78, in step 234. Thus, the sealing assembly 52 is unlocked from the wellhead 12 and may move axially upward relative to the wellhead 12.

With the sealing assembly 52 unlocked from the wellhead 12 and the flexible finger 150 within the corresponding retrieval recess 152, further axially upward movement of the retrieval tool 130 may pull the sealing assembly 52 axially upward, thereby facilitating removal of the sealing assembly 52 from the wellhead 12, in step 236. The above disclosed method enables retrieving the sealing assembly 52 from the wellhead via axial movement of the retrieval tool 130 and the sealing assembly 52, and without rotational movement of any component of the retrieval tool 130 or the sealing assembly 52 relative to the wellhead 12.

As noted above, the positional lug 140 and the angled slot 144 are provided in certain embodiments of the retrieval tool 130. In such cases, even after the outer support extension 155 is positioned radially outward of the flexible finger 150 of the inner retrieval sleeve 136, the retrieval tool 130 may be separated from the sealing assembly 52 and removed from the wellhead 12. In particular, the retrieval tool body 132 may be rotated in the circumferential direction 58 to enable separation of the retrieval tool 130 from the sealing assembly 52, as discussed above. Such a configuration may enable an operator or control system to abort the sealing assembly retrieval process. Thus, the operator or control system may remove the retrieval tool 130, while leaving the sealing assembly 52 in the set position 110 within the wellhead 12.

Figure 13:
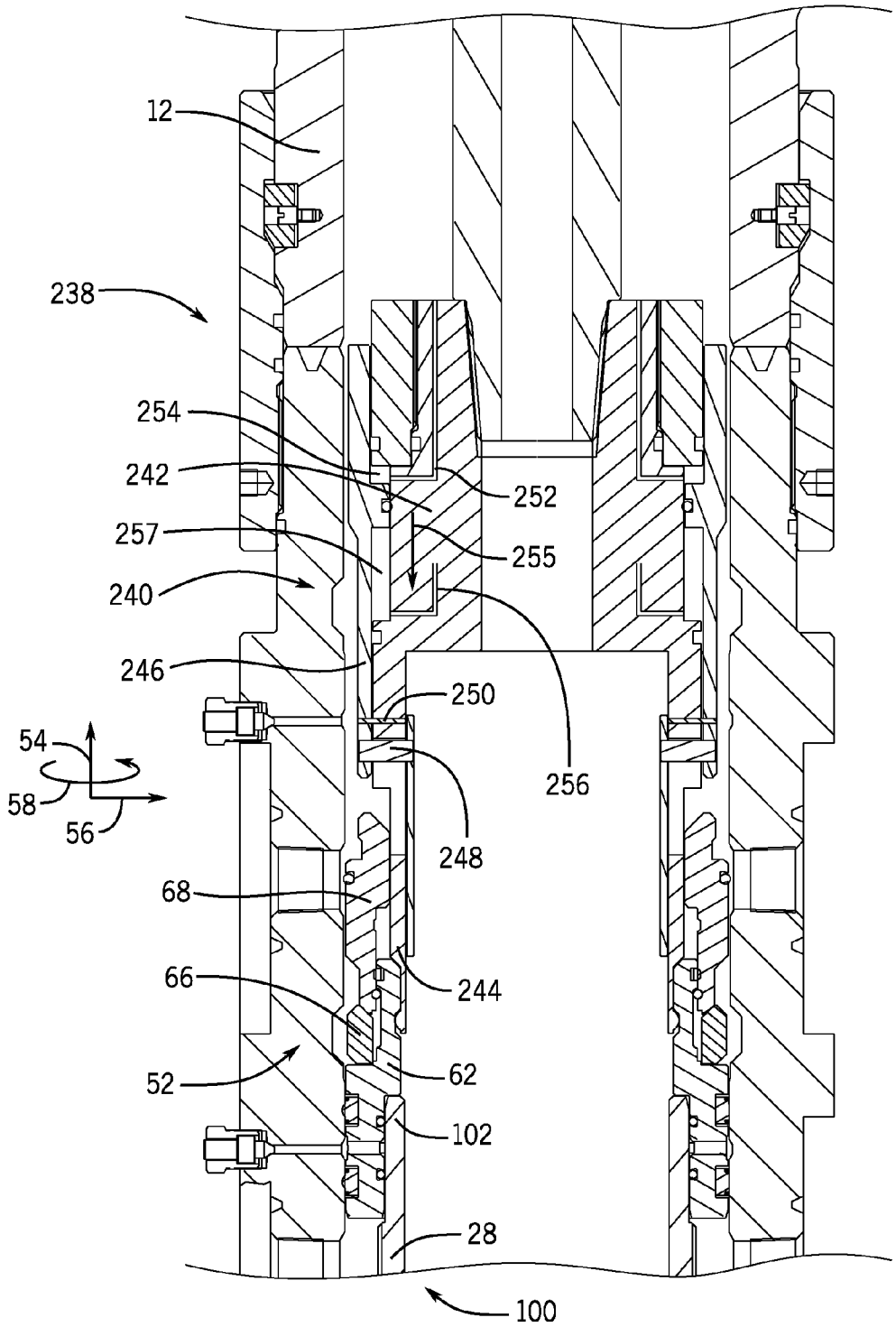
FIG. 13 is a partial cross-section of an embodiment of a hydraulic setting tool having a hydraulic actuation system.

FIG. 13 is a partial cross-section of an embodiment of a hydraulic setting tool 238 having a hydraulic actuation system 240. As noted above with respect to FIGS. 2-5, in certain embodiments, the setting tool 50 may set the sealing assembly 52 via a downward movement of the outer sleeve 80. In the illustrated embodiment, the hydraulic actuation system 140 may be utilized to set the sealing assembly 52. As shown in FIG. 13, the hydraulic setting tool 238 includes a setting tool body 242, which may include or be coupled to an inner sleeve 244. The hydraulic setting tool 238 also includes an outer sleeve 246 disposed radially outward of the setting tool body 242 and the inner sleeve 244. The inner sleeve 244 and the outer sleeve 246 may be slidingly coupled to one another by a pin 248 (e.g., a dowl pin). Additionally, a shear pin 250 extends between the inner sleeve 244 and the outer sleeve 246 to block movement of the inner sleeve 244 and the outer sleeve 246 relative to one another while the shear pin 250 is intact.

The hydraulic setting tool 238 and the sealing assembly 52 may be lowered into the wellhead 12 until the sealing assembly 52 is in the landed position 100 and is supported by the shoulder 102 of the hanger 28. Once the sealing assembly 52 is in the landed position 100, the hydraulic actuation system 240 provides fluid through a first fluid channel 252 into a first space 254 (e.g., an annular space or gap) between the setting tool body 242 and the outer sleeve 246. Accumulation of the fluid in the first space 254 drives the outer sleeve 246 to move axially downward relative to the setting tool body 242 as shown by arrow 255, thereby shearing the shear pin 250. Once the shear pin 250 shears, the outer sleeve 246 may move axially relative to the inner sleeve 244, as discussed in more detail below. Additionally, in some embodiments, the hydraulic actuation system 240 may also include a second fluid channel 256 to facilitate flow of the fluid from a second space 257 to enable the outer sleeve 246 to move axially downward.

Figure 14:
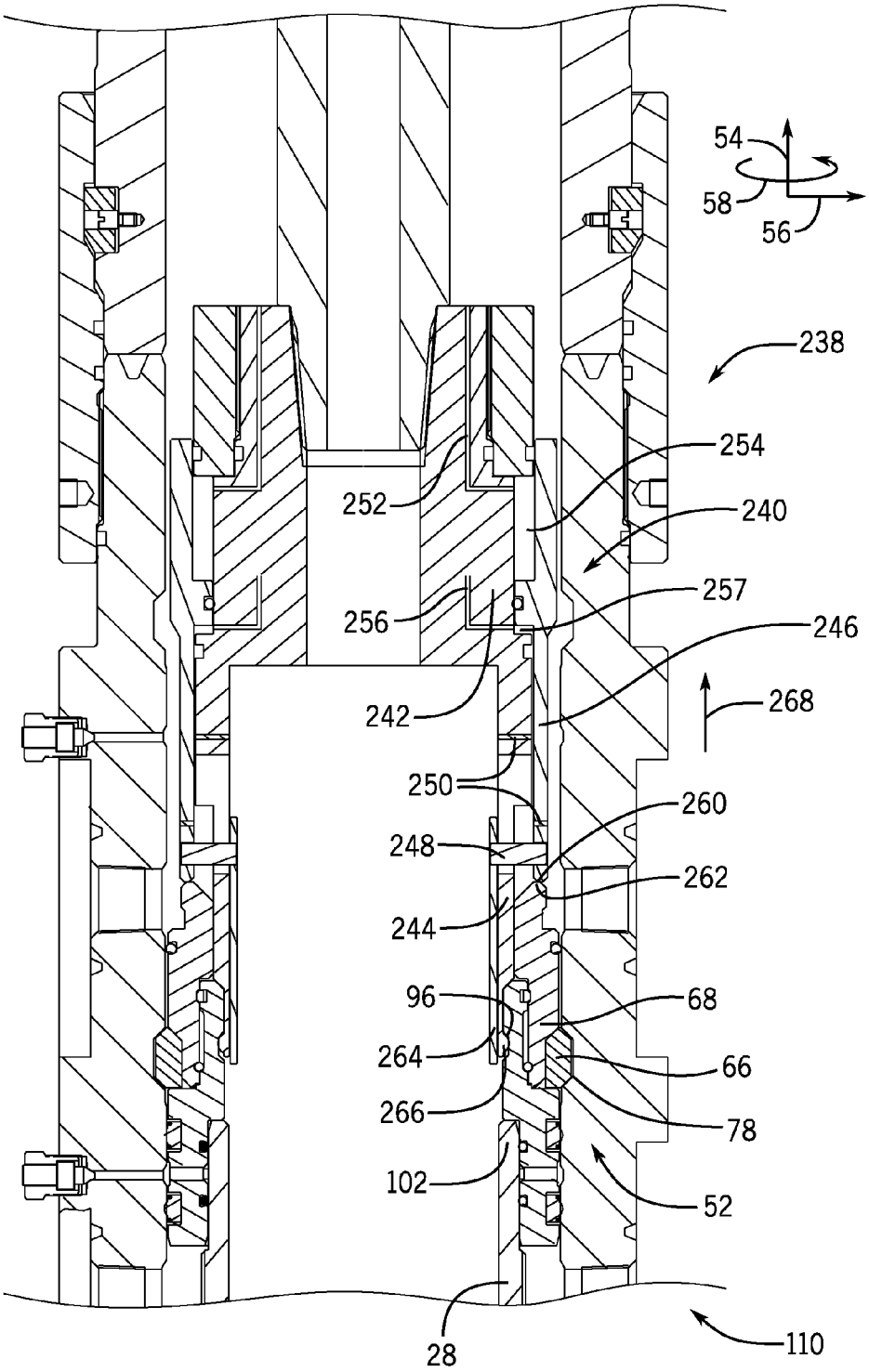
FIG. 14 is a partial cross-section of the hydraulic setting tool of FIG. 13 with a sealing assembly in a set position.

FIG. 14 is a partial cross-section of the hydraulic setting tool 238 with the sealing assembly 52 in the set position 110. After the sealing assembly 52 is lowered into the landing position 100 of FIG. 13, the hydraulic setting tool 238 interacts with the sealing assembly 52 to transition the sealing assembly 52 into the illustrated set position 110. In particular, fluid is provided through the first fluid channel 252 into the first space 254, thereby driving the outer sleeve 246 axially downward. In some cases, fluid is removed from the second space 257 via the second fluid channel 256, thereby enabling the outer sleeve 246 to move axially downward. The fluid pressure applied to the outer sleeve 246 shears the shear pin 250 and enables the outer sleeve 246 to move axially downward relative to the setting tool body 242 and the inner sleeve 244. As the outer sleeve 246 moves axially downward, a lower axial surface 260 of the outer sleeve 246 contacts an upper axial surface 262 of the push ring 68 of the sealing assembly 52, thereby driving the push ring 68 to move axially downward. As discussed above with respect to FIGS. 2-5, such axially downward movement of the push ring 68 drives the locking ring 66 radially outward to engage the corresponding locking recess 78, thereby locking the sealing assembly 52 within the wellhead 12.

In the illustrated embodiment, the pin 248 slidingly couples the inner sleeve 244 to the outer sleeve 246 and/or blocks relative rotation of these components during the setting process. As shown, the inner sleeve 244 includes a flexible finger 266 configured to engage the corresponding setting recess 96 of the sealing assembly 52 and to removably couple the hydraulic setting tool 238 to the sealing assembly 52, in a similar manner as discussed above with respect to FIGS. 2-5. Additionally, in the illustrated embodiment, an inner support extension 264 is coupled to the outer sleeve 246 via the pin 248 and moves axially with the outer sleeve 246 to provide support to the flexible finger 266.

After the sealing assembly 52 is in the set position 110, the fluid may flow out of the first space 254 via the first fluid channel 252 and/or the fluid may flow into the second space 257 via the second fluid channel 256. As the fluid flows from the first space 254 and/or into the second space 257, the outer sleeve 246 moves axially upward, as shown by arrow 268. With the sealing assembly 52 in the set position 110, further axially upward movement of the hydraulic setting tool 238 induces the flexible finger 266 to flex radially inward out of the corresponding setting recess 96 of the sealing assembly 52, thereby facilitating separation of the hydraulic setting tool 238 from the sealing assembly 52. Thus, the hydraulic setting tool 238 may be removed from the wellhead 12. The hydraulic setting tool 238 disclosed herein is configured to lower and to set the sealing assembly 52 within the wellhead 12 via axial movement of the components of the hydraulic setting tool 238 and without rotation of any of the components of the hydraulic setting tool 238 relative to the wellhead 12. Additionally, the hydraulic setting tool 238 may be separated from the sealing assembly 52 without rotation of any component of the hydraulic setting tool 238 relative to the wellhead 12.

Although the sealing assembly 52 and the hanger 28 are shown as separate components that are separately installed and removed from the wellhead 12, it should be understood that in some embodiments, the sealing assembly 52 and the hanger 28 may be fixed to one another and/or installed into the wellhead 12 together. In some such cases, the sealing assembly 52 and the hanger 28 may be lowered axially into the wellhead 12 together until the hanger 28 contacts a previously installed hanger or other surface feature configured to support the hanger 28. Once the hanger 28 and the attached sealing assembly 52 are supported within the wellhead 12 (e.g., in a landed position), the setting tool 50 or the hydraulic setting tool 238 may set the sealing assembly 52 in the manner set forth above.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a setting tool; and a sealing assembly for sealing an annular space between a hanger and a wellhead, the sealing assembly comprising:

an annular seal body supporting a locking ring and supporting one or more annular seals configured to seal the annular space; and a push ring disposed axially above the annular seal body;

wherein a corresponding setting recess is formed in a radially inner surface of the annular seal body and is configured to receive a flexible setting finger of the setting tool to enable setting the sealing assembly within the wellhead, and a corresponding retrieval recess is formed in a radially outer surface of the push ring and is configured to receive a flexible retrieving finger of a retrieval tool to enable retrieval of the sealing assembly from the wellhead;

wherein the setting tool comprises an outer annular sleeve and an inner annular sleeve, the flexible setting finger extends from the inner annular sleeve of the setting tool, contact between a lower axial surface of the outer annular sleeve and an upper axial surface of the push ring drives the axially downward movement of the push ring to facilitate setting the sealing assembly within the wellhead without rotating any component of the setting tool relative to the wellhead, and the flexible setting finger is configured to flex radially inwardly out of the corresponding setting recess when the setting tool is moved axially upward relative to the sealing assembly, thereby enabling the setting tool to separate from the sealing assembly and to be withdrawn from the wellhead without rotating any component of the setting tool relative to the wellhead.

2. The system of claim 1, wherein the locking ring is configured to move radially outward in response to axially downward movement of the push ring relative to the annular seal body to facilitate setting the sealing assembly within the wellhead.

3. The system of claim 2, comprising the retrieval tool having an outer annular support sleeve and an inner annular retrieval sleeve, wherein the flexible retrieving finger extends from the inner annular retrieval sleeve, and the outer annular support sleeve has an outer support extension configured to rigidly support the flexible retrieving finger as the sealing assembly is retrieved from the wellhead to facilitate retrieval of the sealing assembly without rotating any component of the retrieval tool relative to the wellhead.

4. The system of claim 1, wherein the setting tool comprises a shear pin extending between the outer annular sleeve and the inner annular sleeve, the shear pin is configured to break in response to axial compression of the setting tool to enable the outer annular sleeve to move axially relative to the inner annular sleeve and to contact the upper axial surface of the push ring.

5. The system of claim 1, comprising a slot guide protruding radially inward from a radially inner surface of the outer annular sleeve and a corresponding slot guide recess formed in a radially outer surface of the inner annular sleeve to block rotational movement of the outer annular sleeve relative to the inner annular sleeve.

6. The system of claim 1, comprising a hydraulic actuation system having a fluid channel configured to flow a fluid into an annular gap between the outer annular sleeve and the inner annular sleeve to drive the outer annular sleeve axially downward relative to the inner annular sleeve to contact the upper axial surface of the push ring.

7. The system of claim 3, wherein the retrieval tool comprises a shear pin extending between an annular retrieval tool body disposed between the outer annular support sleeve and the inner annular retrieval sleeve, and the shear pin is configured to break in response to axial compression of the retrieval tool to enable the annular retrieval tool body to move axially relative to the inner annular retrieval sleeve and to enable the outer support extension of the outer annular support sleeve to move axially downward into a support position radially outward of the flexible retrieval finger in response to downward axial movement of the annular retrieval tool body to facilitate retrieval of the sealing assembly from the wellhead.

8. The system of claim 7, wherein the annular retrieval tool body and the outer annular support sleeve are slideably coupled to one another via a positional lug and a corresponding slot, wherein the corresponding slot comprises an axial portion and a circumferential portion, and the positional lug is configured to block relative axial movement between the annular retrieval tool body and the outer annular support sleeve when the positional lug is disposed in the circumferential portion.

9. The system of claim 1, wherein each of the one or more annular seals is supported within a respective annular groove formed in a radially outer surface of the annular seal body.

10. The system of claim 3, wherein the outer support extension of the outer annular support sleeve is configured to move axially downward relative to the inner annular retrieval sleeve into a support position radially outward of the flexible retrieval finger to rigidly support the flexible retrieving finger as the sealing assembly is retrieved from the wellhead.

11. A system, comprising:

a sealing assembly for sealing an annular space between a hanger and a wellhead, the sealing assembly comprising:

an annular seal body supporting a locking ring; and a push ring disposed axially above the annular seal body;

wherein a corresponding setting recess is formed in a radially inner surface of the annular seal body and is configured to receive a flexible setting finger to enable setting the sealing assembly within the wellhead, and a corresponding retrieval recess is formed in a radially outer surface of the push ring and is configured to receive a flexible retrieving finger to enable retrieval of the sealing assembly from the wellhead; and a tool comprising the flexible setting finger or the flexible retrieving finger, wherein the tool comprises a shear pin extending between an outer annular sleeve and an inner annular sleeve, and the shear pin is configured to break in response to axial compression of the tool to enable the outer annular sleeve and the inner annular sleeve to move relative to one another to facilitate setting the sealing assembly within the wellhead or retrieving the sealing assembly from the wellhead.

12. A system, comprising:

a setting tool;

a sealing assembly for sealing an annular space between a hanger and a wellhead, the sealing assembly comprising:

an annular seal body supporting a locking ring; and a push ring disposed axially above the annular seal body;

wherein a corresponding setting recess is formed in a radially inner surface of the annular seal body and is configured to receive a flexible setting finger of the setting tool to enable setting the sealing assembly within the wellhead, and a corresponding retrieval recess is formed in a radially outer surface of the push ring and is configured to receive a flexible retrieving finger of a retrieval tool to enable retrieval of the sealing assembly from the wellhead; and a hydraulic actuation system having a fluid channel configured to flow a fluid into an annular gap between an outer annular sleeve of the setting tool and an inner annular sleeve of the setting tool to drive the outer annular sleeve axially downward relative to the inner annular sleeve to facilitate setting the sealing assembly within the wellhead.

13. A system, comprising:

a retrieval tool; and a sealing assembly for sealing an annular space between a hanger and a wellhead, the sealing assembly comprising:

an annular seal body supporting a locking ring and supporting one or more annular seals configured to seal the annular space; and a push ring disposed axially above the annular seal body;

wherein a corresponding setting recess is formed in a radially inner surface of the annular seal body and is configured to receive a flexible setting finger of a setting tool to enable setting the sealing assembly within the wellhead, and a corresponding retrieval recess is formed in a radially outer surface of the push ring and is configured to receive a flexible retrieving finger of the retrieval tool to enable retrieval of the sealing assembly from the wellhead;

wherein the locking ring is configured to move radially outward in response to axially downward movement of the push ring relative to the annular seal body to facilitate setting the sealing assembly within the wellhead, the retrieval tool comprises an outer annular support sleeve and an inner annular retrieval sleeve, the flexible retrieving finger extends from the inner annular retrieval sleeve, the outer annular support sleeve has an outer support extension configured to rigidly support the flexible retrieving finger as the sealing assembly is retrieved from the wellhead to facilitate retrieval of the sealing assembly without rotating any component of the retrieval tool relative to the wellhead, and the outer support extension of the outer annular support sleeve is configured to move axially downward relative to the inner annular retrieval sleeve into a support position radially outward of the flexible retrieval finger to rigidly support the flexible retrieving finger as the sealing assembly is retrieved from the wellhead.

* * * * *